US007784996B1

(12) United States Patent
Cummer

(10) Patent No.: US 7,784,996 B1
(45) Date of Patent: Aug. 31, 2010

(54) MORTAR MIXING APPARATUS

(76) Inventor: Thomas J. Cummer, P.O. Box 65, Sherrill, IA (US) 52073

( * ) Notice: Subject to any disclaimer, the term of this patent is extended or adjusted under 35 U.S.C. 154(b) by 744 days.

(21) Appl. No.: 11/654,348

(22) Filed: Jan. 17, 2007

(51) Int. Cl.
*B28C 5/14* (2006.01)

(52) U.S. Cl. ..... 366/50; 366/64; 366/186

(58) Field of Classification Search ..... 366/14–15, 366/20, 27–28, 35, 37, 38, 49, 50, 61, 64–66, 366/153.2, 153.3, 155.2–157.2, 158.4, 186, 366/192–193, 297–300, 319–320, 51
See application file for complete search history.

(56) References Cited

U.S. PATENT DOCUMENTS

| | | | | | |
|---|---|---|---|---|---|
| 1,753,716 | A | | 4/1930 | Owen | |
| 1,829,479 | A | | 10/1931 | Elkins | |
| 2,606,645 | A | | 8/1952 | Heine | |
| 3,006,615 | A | * | 10/1961 | Mason, Jr. | 366/20 |
| 3,366,368 | A | | 1/1968 | Hibbing | |
| 3,482,821 | A | * | 12/1969 | Blackwood | 366/186 |
| 3,570,569 | A | * | 3/1971 | Hartley et al. | 241/82.6 |
| 4,043,540 | A | | 8/1977 | Stone | |
| 4,097,926 | A | | 6/1978 | Face, Jr. | |
| 4,117,547 | A | * | 9/1978 | Mathis et al. | 366/17 |
| 4,147,331 | A | | 4/1979 | Kopecky | |
| 4,432,499 | A | * | 2/1984 | Henkensiefken et al. | 241/30 |
| 4,615,647 | A | * | 10/1986 | Lukacz | 406/60 |
| 4,692,028 | A | * | 9/1987 | Schave | 366/22 |
| 5,122,038 | A | | 6/1992 | Malkoski | |
| 5,314,100 | A | | 5/1994 | Deaver | |
| 5,333,762 | A | * | 8/1994 | Andrews | 222/238 |
| 5,361,711 | A | * | 11/1994 | Beyerl | 111/127 |
| 5,524,796 | A | * | 6/1996 | Hyer | 222/241 |
| 5,609,416 | A | | 3/1997 | Duckworth | |
| 5,624,183 | A | | 4/1997 | Schuff | |
| 5,785,420 | A | | 7/1998 | Schuff | |
| 5,803,596 | A | * | 9/1998 | Stephens | 366/10 |
| 5,827,038 | A | | 10/1998 | Barden | |
| 5,848,871 | A | | 12/1998 | Thiessen | |

(Continued)

FOREIGN PATENT DOCUMENTS

DE 3629674 A1 * 3/1988

OTHER PUBLICATIONS

EZ Grout Corporation, Waterford OH; GH-75 Grout Hog brochure, undated.

(Continued)

*Primary Examiner*—Charles E Cooley
(74) *Attorney, Agent, or Firm*—Allan L. Harms; Shuttleworth & Ingersoll, PLC

(57) ABSTRACT

A mortar mixing apparatus includes a screw conveyor disposed below the bottom of a mixing container in which a selectively operable agitator is located. An elongate opening in the bottom of the mixing container is open into the housing of the screw conveyor so that mixed mortar may flow into the screw conveyor. The screw conveyor may be rotated in a reverse direction to force materials upward into the mixing container, or it may be operated in a forward direction to convey mortar away from the mixing container. The agitator and the screw conveyor are independently driven by hydraulic motors.

18 Claims, 4 Drawing Sheets

U.S. PATENT DOCUMENTS

| | | | | |
|---|---|---|---|---|
| 6,112,955 | A | 9/2000 | Lang | |
| 6,123,445 | A | 9/2000 | Grassi | |
| 6,206,249 | B1 * | 3/2001 | Lang et al. | 222/412 |
| 6,227,813 | B1 | 5/2001 | Leimer | |
| RE37,911 | E | 11/2002 | Lang | |
| 6,666,573 | B2 | 12/2003 | Grassi | |
| 7,357,564 | B2 * | 4/2008 | Reis et al. | 366/160.4 |
| 2006/0034146 | A1 * | 2/2006 | Lang | 366/26 |
| 2006/0054645 | A1 | 3/2006 | Lang | |

OTHER PUBLICATIONS

Schuff Steel Company, Jr. Mix brochure, undated, Phoenix, AZ.

Triple S Sales, Inc. website (www.triplesvinylsales.net/07catalog/pg8.html)-Auger Bucket Mixer and Dispenser, Part #A2000, Aug. 14, 2007, Lee and Karen Shafer, Overton NE 68863.

Talet Attachments International website (www.taletattachments.com/augerbucket)—Auger Bucket, Aug. 14, 2007, Strathmore, Alberta, Canada.

* cited by examiner

MORTAR MIXING APPARATUS

FIELD OF THE INVENTION

This invention pertains to devices to mix mortar and other fluent materials used in masonry construction.

BACKGROUND OF THE INVENTION

In the conventional preparation of mortar for masonry applications, aggregate materials are mixed with lime, Portland cement and water in a mixer having an open-topped tub supported on an axle so that the tub can be tipped and its contents dumped into a transporting container which then can be moved closer to the site where the mortar is needed. The mixing tub of the conventional mortar mixer is provided with an agitator to cause intermixing of the ingredients of the mortar. When mortar is sufficiently well mixed by the agitator, the agitation is stopped so that the tub can be tipped by rotating it about its support so that the mortar contents will empty by gravity into a transporting container. An example of a conventional mortar mixer which can be tilted for dumping is found in Stone, deceased, U.S. Pat. No. 4,043,540.

Conventionally, mortar or other fluent masonry material having first been mixed, has been transported by wheelbarrow or cart to the site where the mortar is needed. It is also well known to use an intermediary carrier such as a hopper to receive mortar poured from the mixer and then to transport the hopper to the site where the mortar is needed. One example of a hopper device to transport fluent material is provided with an auger mounted along the lowermost region of the transport hopper such that gravity will feed the fluent material from the hopper into the auger so that it can be forced from the hopper as the auger is run in a forward direction. An example of a hopper device with a discharging auger is shown in Lang, et al. U.S. Pat. No. 6,206,249.

The mixing of the mortar in a first machine followed by its transfer to a hopper for transport creates inefficiencies and requires investment in separate machines to mix the mortar and to transport the mortar. A machine is needed which allows mixing of mortar and its transport to the place where it is desired without movement of the mortar from the mixing machine to a separate transport hopper.

SUMMARY

This invention provides an improved mortar mixing machine which also provides a delivery mechanism to transport the mixed mortar to the site where the mortar is needed.

The improved mortar mixing machine includes a mixing container which is generally cylindrical in shape with its axis oriented horizontally. An opening is provided along the top of the mixing container through which mortar ingredients may enter the mixing container. Another opening extending along the bottom of the mixing container opens into an elongate screw conveyor which extends along the length of the container and extends further from below the container. The screw conveyor is driven by a hydraulic motor which may be operated in either a forward or a reverse direction. An internal combustion engine is supported on the container housing to power a hydraulic pumping system which in turn provides compressed hydraulic fluid to power the hydraulic motors of the machine. A battery is also provided with the machine to provide power to control valves of the hydraulic pumping system and to start the internal combustion engine.

An agitator is centrally located in the mixing container and is supported in a horizontal orientation upon the opposing end walls of the container. The agitator includes paddles extending radially from a rotatable shaft. The agitator shaft is driven by a separate drive motor so that when component ingredients of mortar are placed in the container, the ingredients may be adequately mixed by action of the agitator. The paddles of the agitator define a path spaced a small distance from the sidewalls of the container but do not enter the screw conveyor housing as they turn. When the agitator is operated to mix mortar ingredients, the screw conveyor is driven in a reverse direction so that ingredients which fall into the screw housing are urged upward into the container to be mixed into the mortar mixture by the agitator. The mixing container is supported on an underlying base which includes fork lift openings so that the machine can be elevated if desired. The mixing container is selectively rotatable upon the base by use of a third hydraulic slew motor.

Once the mortar is adequately mixed and ready for use, the container may be transported to a position near where mortar is to be deposited. Thereupon the screw conveyor may be operated in a forward direction to urge mortar from the container along the screw conveyor housing into a discharge chute which is directed radially downward from the motor end of the conveyor housing so that mixed mortar may be discharged into hoses or other tubing which may be joined to the chute.

It is a primary object of the invention to provide a mortar mixer which can discharge mortar without tipping of the mixer container. Another object of the invention is to provide a mortar mixer with an underlying discharge screw conveyor which can be operated in reverse to force materials within the screw conveyor housing upward into the container to be mixed thoroughly with other materials present in the container. It is a further object of the invention to provide a mortar mixer which can mix component ingredients into mortar and then deliver the mixed mortar to the site where the mortar is to be used. An additional object of the invention is to provide a mortar mixer which can serve as a transporter for mixed mortar. Yet a further object of the invention is to provide a mortar mixing system which requires no transfer of mixed mortar into a hopper for delivery to the work site.

These and other objects of the invention will be understood from a close examination of the detailed description of the invention which follows.

DESCRIPTION OF THE DRAWING FIGURES

DETAILED DESCRIPTION OF THE INVENTION

Figure 1:
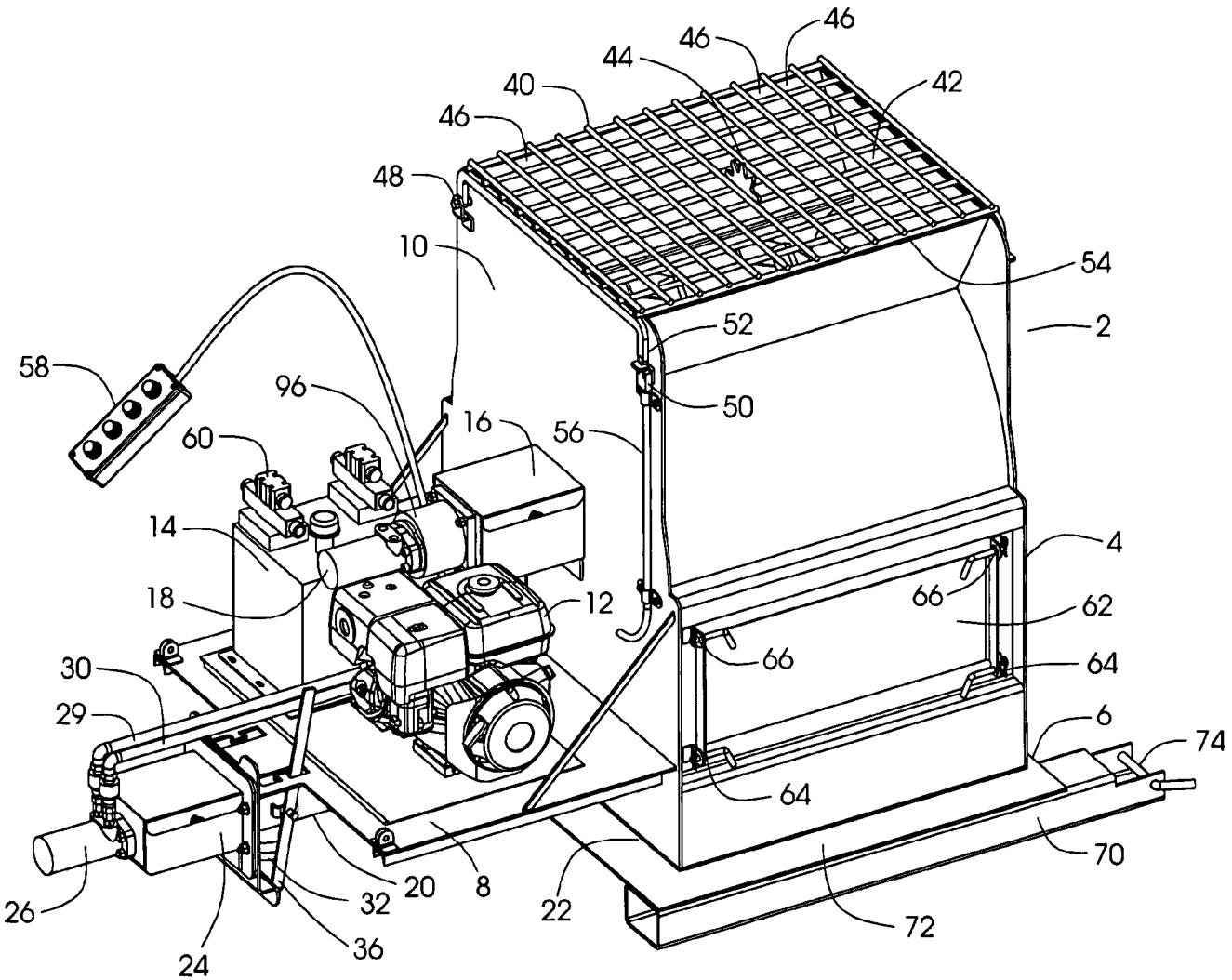
FIG. 1 is a front left perspective of the mortar mixer of my invention.

Referring to the drawings and particularly to FIG. 1, the mortar mixer invention 2 is shown ready for operation. Invention 2 comprises a housing 4 rotatably supported upon base 6. A shelf 8 supported on first end wall 10 of housing 4 supports an internal combustion engine 12 operatively coupled to a hydraulic pumping system 14. A battery may be supported on invention 2, preferably on shelf 8, to provide electrical power for control use and to power an optional starter for engine 12.

Extending from first end wall 10 of housing 4 is first shaft coupler housing 16 from which gear box 96 and agitator drive motor 18 axially extend. Agitator drive motor 18 is operatively coupled to the hydraulic pumping system 14 so that agitator drive motor 18 may be selectively operated by pressurized hydraulic fluid supplied by a hydraulic pumping system 14. First shaft coupler housing 16 encloses conventional shaft coupling and shaft seal components.

Preferably screw conveyor 20 extends from first end wall 10 of housing 4 near the bottom 22 of housing 4. Preferably screw conveyor 20 extends from beneath shelf 8. A first screw conveyor bearing enclosure 24 is joined axially to screw conveyor 20 and screw conveyor drive motor 26 axially extends from first screw conveyor bearing enclosure 24. First screw conveyor bearing enclosure 24 houses a shaft coupling and pillow block bearings and shaft seals. Screw conveyor drive motor 26 can be selectively operated independently from operation of agitator drive motor 18. Screw conveyor drive motor 26 is driven by compressed hydraulic fluid supplied along first hydraulic line 28 and returned by way of second hydraulic line 30.

A discharge tube 32 is joined radially to screw conveyor 20 near its coupling to first screw conveyor bearing enclosure 24. A manually operated closure mechanism 36 may be operated to control flow of mortar along a flexible hose (not illustrated) attached to discharge tube 32. In the preferred embodiment of FIGS. 1-4, closure mechanism 36 is a bar which impinges on the flexible hose attached to discharge tube 32 to pinch off flow through the hose.

Housing 4 further comprises a grate 40 which selectively overlies opening 42 through which mortar ingredients may be introduced into mixing container 80 (see FIG. 2) within housing 4. Toothed protrusion 44 is fixed to and extends above grate 40. Toothed protrusion 44 may be used to puncture and rip bags of Portland cement or other mortar ingredients to expedite their addition through grate openings 46.

Grate 40 is pivotally mounted to housing 4 by first brackets 48 (see FIG. 4 also) so that grate 40 may be selectively pivoted upwards and away from opening 42. A normally open safety switch 50 is mounted to first end wall 10 in alignment with the path of free arm 52 of grate 40. When grate 40 is in its closed position resting upon upper end 54 of housing 4 and overlying opening 42, safety switch 50 is urged by free arm 52 to its closed position, thereby enabling operation of agitator drive motor 18 and screw conveyor drive motor 26. Conduit 56 protects electrical wiring which couples safety switch 50 to the hydraulic pumping system 14. Neither agitator motor 18 nor screw conveyor drive motor 26 will operate when free arm 52 is lifted off safety switch 50 because valve 60 is prevented from directing hydraulic fluid to either motor when safety switch 50 is opened.

Housing 4 is further provided with door 62 which is retained to housing 4 by upper hinge pins 66 and by lower hinge pins 64. Door 62 encloses a storage area within housing 4. Door 62 may pivot about either upper hinge pins 66 or lower hinge pins 64 when the other set of hinge pins are removed.

Base 6 comprises a pair of spaced apart box beams 70 upon which plate 72 is welded. Box beams 70 (see FIG. 3) are spaced apart to accommodate the spacing of tines of a fork lift machine (not illustrated). Each box beam 70 is sized to allow a tine of a fork lift machine to be inserted into it. Once a tine has been inserted fully into box beam 70, pin 74 may be used to secure the tine to box beam 70.

Control pendant 58 permits entry of user commands to cause selective operation of agitator drive motor 18 and screw conveyor motor 26 by electrical control of hydraulic pumping system 14. Each motor 18 and 26 is independently operable.

Figure 2:
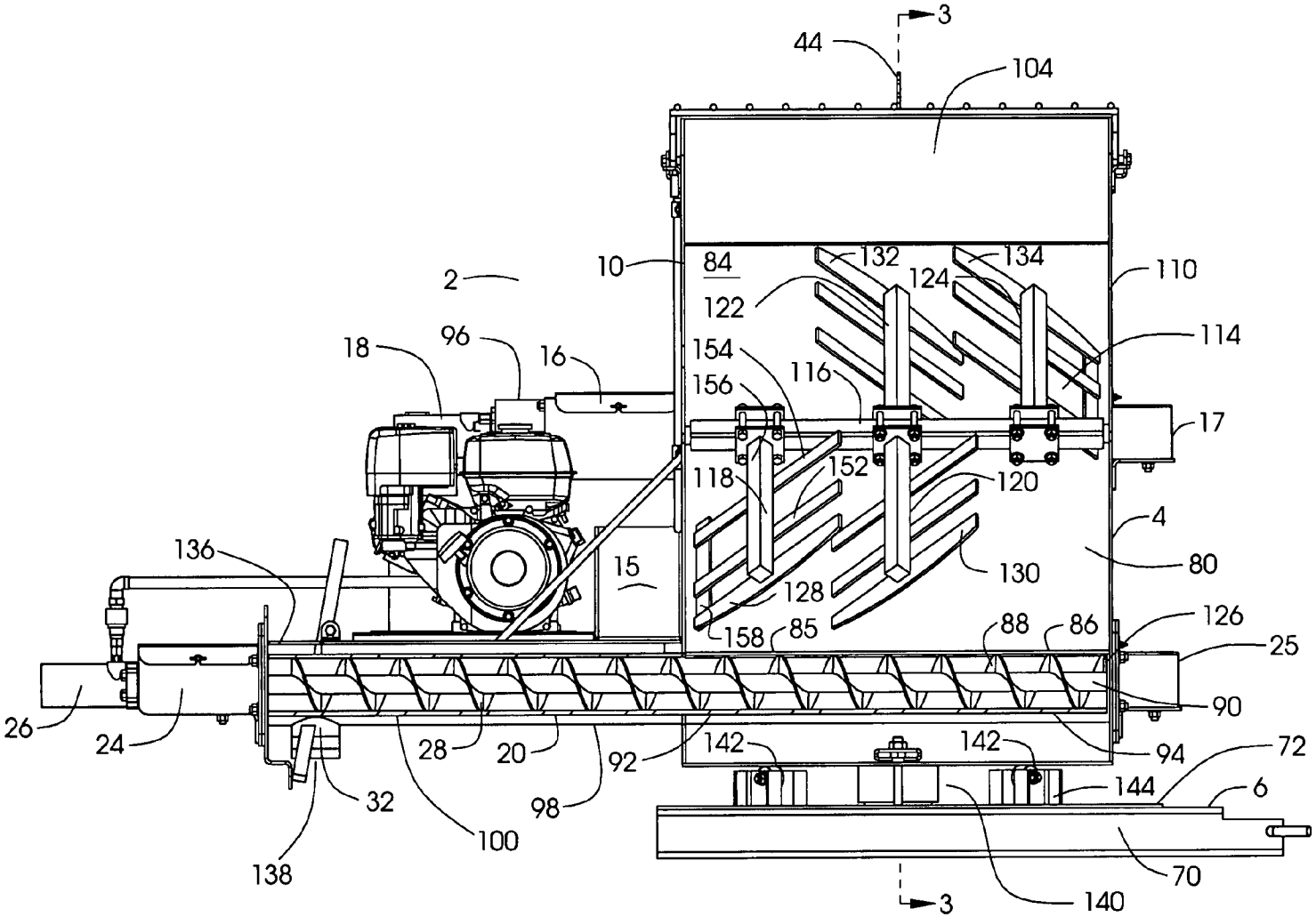
FIG. 2 is a front elevation with the front walls of the housing 4 and of the screw conveyor 20 cut away.
Figure 3:
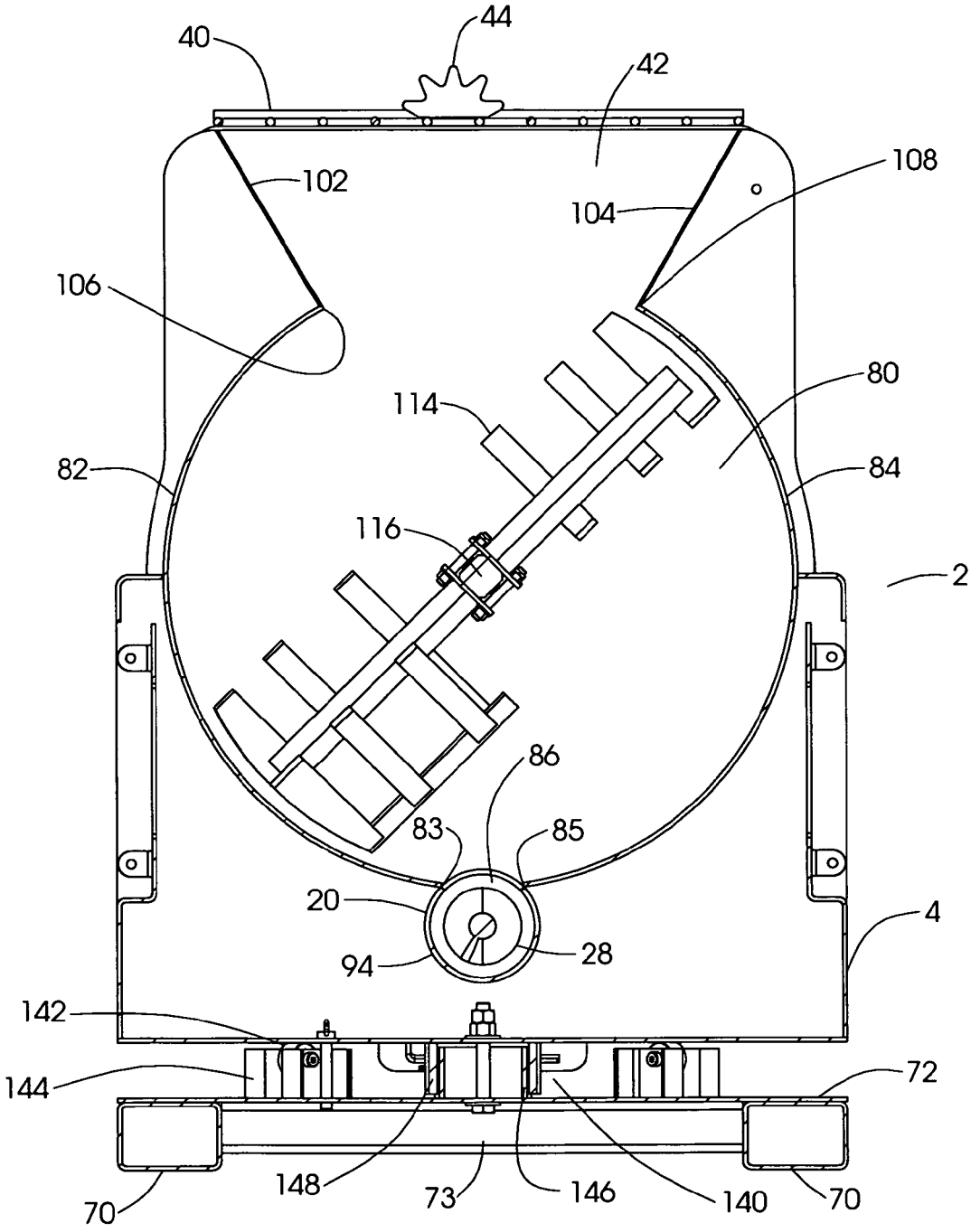
FIG. 3 is a view of the mortar mixer of FIG. 1 in section taken along line 3-3 of FIG. 1.
Figure 4:
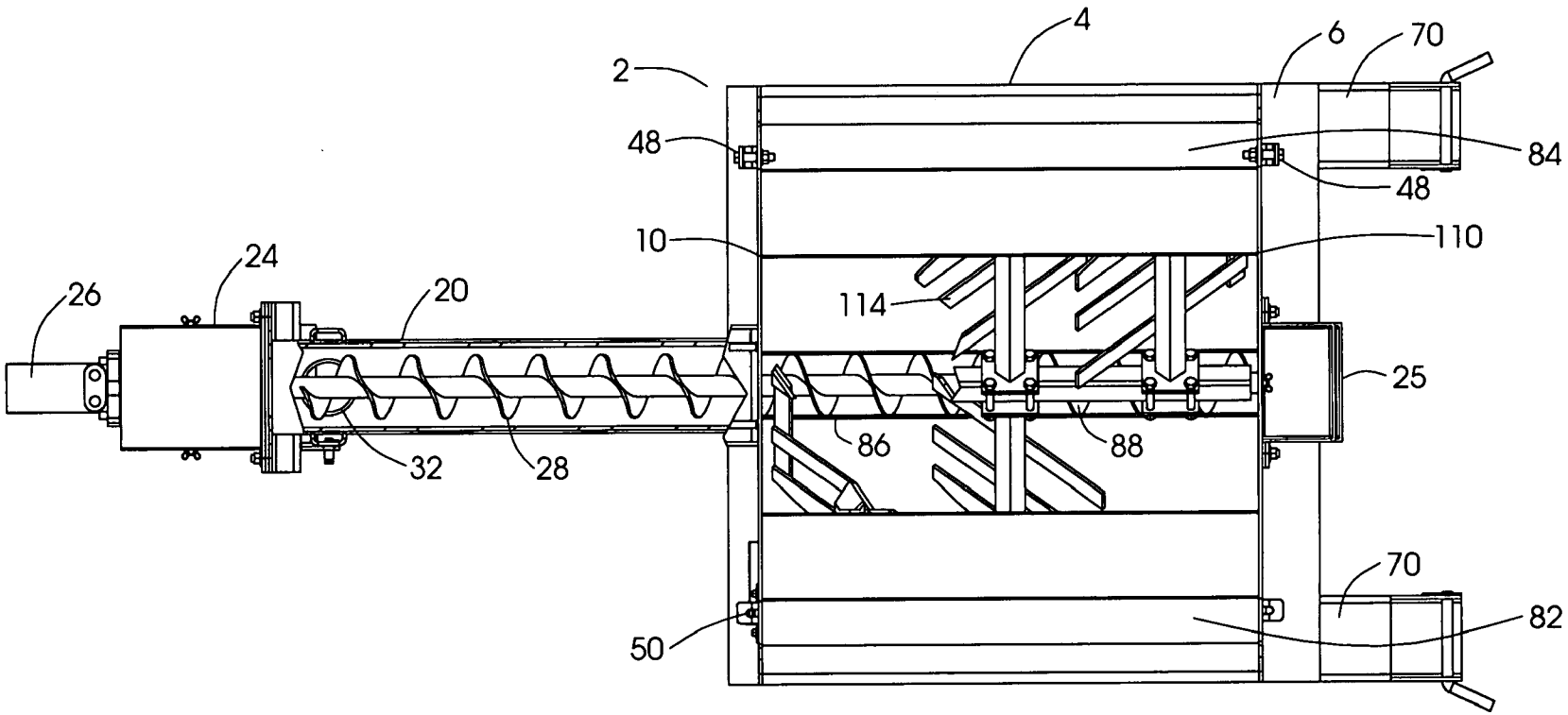
FIG. 4 is a top plan view of the invention with the internal combustion engine and the top grate omitted, and with parts of the screw conveyor and of the agitator and its drive motor cut away.

Referring now particularly to FIGS. 2-4, internal details of invention 2 are observable. Mixing container 80 is mounted within housing 4 and is generally cylindrical in shape, with closed ends corresponding with end walls 10 and 110 of housing 4. Mixing container 80 comprises opposing curved sidewalls 82 and 84 which are spaced apart at the upper ends 106 and 108 thereof to provide top opening 42. The radius of each sidewall 82 and 84 is substantially uniform therealong.

Screw conveyor 20 is disposed generally horizontally and comprises first segment 92 which extends the length between first end wall 10 and opposing second end wall 110 of housing 4. First segment 92 of screw conveyor 20 underlies mixing container 80 at its lowermost region between lower ends 83 and 85 of sidewalls 82 and 84, which are spaced apart and intersect sidewall 94 of first segment 92.

Cylindrical sidewall 94 of first segment 92 of screw conveyor 20 is provided with a slot, namely longitudinal opening 86 therein, which is disposed between the intersections of lower ends 83 and 85 with sidewall 94, and preferably is defined by the intersections of lower ends 83 and 85 with sidewall 94. Opening 86 permits communication between mixing container 80 and the conveyor screw 28 along the length of first segment 92 though opening 86 may be shortened so that it does not extend fully between first end wall 10 and second end wall 110. Opening 86 is narrower than the diameter of sidewall 94 of screw conveyor 20.

Conveyor screw shaft 90 is supported at its opposing ends by bearings within first screw conveyor bearing enclosure 24 and second screw conveyor bearing enclosure 25. Second segment 98 of screw conveyor 20 axially joins first segment 92 thereof and extends exteriorly of housing 4. Second segment 98 includes a sidewall 100 which entirely encloses conveyor screw 28 and extends from first screw conveyor bearing enclosure 24 to first end wall 10. The extension of second segment 98 of screw conveyor 20 need not extend fully below shelf 8 in order for invention 2 to operate, though it is preferable for bearing enclosure 24 to be accessible easily and not overlain by shelf 8.

It may be seen that opening 42 is provided with opposing inclined sides 102 and 104 such that materials emptied into opening 42 are funneled by inclined sides 102 and 104 into mixing container 80.

Mixing container 80 defines a substantially cylindrical volume within which agitator assembly 114 is rotatable about the axis of drive shaft 116. Drive shaft 116 may be selectively driven in rotation by agitator drive motor 18.

Agitator assembly 114 comprises paddles 118, 120, 122 and 124 which radially extend from drive shaft 116 and are rotatable within mixing container 80. Agitator assembly 114 is supported on opposing end walls 10 and 110 of housing 4 by bearings within first shaft coupler housing 16 and second agitator bearing housing 17. The distal beater bars 128, 130, 132 and 134 of paddles 118, 120, 122 and 124 respectively define a path along and spaced a small distance from sidewalls 82 and 84 of mixer container 80. Conveyor screw 28 is sized and disposed within first segment 92 such that distal beater bars 128, 130, 132 and 134 will not strike the flighting 88 of conveyor screw 28 though they will pass through elongate opening 86 between lower ends 83 and 85 of sidewalls 82 and 84.

Paddle 118 comprises distal beater bar 128, medial bar 152 and proximal bar 154 all mounted to radial arm 156 which is detachably mounted to drive shaft 116. A connecting bar 158 interconnects adjacent ends of the distal beater bar 128, the medial bar 152 and the proximal bar 154. Paddle 124 has similar structure.

It is critical to appreciate that agitator drive motor 18 is operable entirely independently from screw conveyor drive motor 26, and further that conveyor screw 28 may be driven selectively in a clockwise or counterclockwise direction. When unmixed mortar ingredients are present within mixing container 80, agitator assembly 114 may be rotated by drive shaft 116 to intermix the ingredients. So that unmixed ingredients do not accumulate in first segment 92 of screw conveyor 20, conveyor screw 28 may be driven in a counterclockwise direction by selective operation of screw conveyor drive motor 26, thereby causing unmixed ingredients within screw conveyor 20 to be urged toward rear end 126 of conveyor screw 28 and then urged upwardly adjacent its rear end 126. Once urged into the path of agitator assembly 114, unmixed ingredients will be churned into the mortar mix being agitated.

When the mortar is thoroughly mixed, the agitator assembly 114 may be idled along with the conveyor screw 28. The entire invention 2 may then be transported to a worksite where mortar is needed. Transport of invention 2 may be by a fork-equipped machine, the tines of which have been inserted into box beams 70. Once stationed near the worksite, the direction of operation of screw conveyor drive motor 26 may be reversed so that mixed mortar which has flowed by gravity into first segment 92 of screw conveyor 20 may be urged along fighting 88 toward discharge end 136 of screw conveyor 20. Because discharge tube 32 is communicative with the interior of screw conveyor 20, mortar moving toward discharge end 136 will be urged by gravity into discharge tube 32. Hoses or ducts may be joined to discharge tube 32 so that mortar may be pumped therealong to a desired location. When closure mechanism 36 is not impinging a hose joined to discharge tube 32, mortar may pass through discharge tube 32 and emerge from outlet 138 of discharge tube 32.

Referring particularly to FIGS. 2 and 3, it may be seen that base 6 comprises a plate 72 supported on spaced apart box beams 70 which provide fork opening for the tines of a fork-equipped lifting apparatus. Transverse beams 73 are disposed between box beams 70 to further create a foundation for plate 72. In FIG. 2, it may be observed that box beams 70 extend from below housing 4 a small distance below shelf 8 and in the opposing direction, box beams 70 extend substantially past second end wall 110 of housing.

Mixing container 80 and housing 4 are supported above base 6 by turntable assembly 140 such that mixing container 80 and housing 4 may be selectively rotated upon base 6. Turntable assembly 140 comprises bearing wheels 142 mounted atop upright posts 144 as well as pivot axle components 146 and 148. Housing 4 may rotate on base 6 when manually turned by the operator. A lock mechanism may be employed to selectively prevent rotation of housing 4 on base 6.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Having described the invention, I claim:

1. Mortar mixing apparatus comprising a base on which a mixing container is supported, a screw conveyor disposed below the mixing container, the mixing container having a bottom opening communicative with the screw conveyor, a first motor operatively coupled to the screw conveyor, the screw conveyor selectively operable by the first motor in a clockwise rotation or in a counterclockwise rotation, the mixing container further comprising an agitator assembly centrally located therein, the agitator assembly coupled to a second motor, the second motor selectively operable independently of the first motor, the agitator assembly selectively operable to intermix mortar ingredients located in the mixing container while the screw conveyor is operated to force mortar ingredients in the screw conveyor into the mixing container, an outer periphery of the agitator assembly passes through an elongate longitudinal opening at a top of a tubular housing of the screw conveyor.

2. The mortar mixing apparatus of claim 1 wherein the mixing container is selectively rotatable upon the base.

3. The mortar mixing apparatus of claim 1 wherein the base comprises at least two spaced apart box tubes, the box tubes adapted to receive tines of a fork lift machine, whereby the mortar mixing apparatus may be elevated by the fork lift machine.

4. The mortar mixing apparatus of claim 1 wherein the mixing container is generally a cylinder having closed ends, the cylinder having a substantially horizontal longitudinal axis.

5. The mortar mixing apparatus of claim 1 wherein a control pendant is coupled to the first motor and to the second motor, whereby operation of the first motor and of the second motor may each be independently controlled by a user entering commands upon the control pendant.

6. The mortar mixing apparatus of claim 1 wherein
an engine is supported on the mixing container,
a hydraulic pumping system operatively coupled to the engine,
the first motor is a hydraulic motor coupled to the hydraulic pumping system.

7. The mortar mixing apparatus of claim 1 wherein
an engine is supported on the mixing container,
a hydraulic pumping system operatively coupled to the engine,
the second motor is a hydraulic motor coupled to the hydraulic pumping system.

8. The mortar mixing apparatus of claim 1 wherein
the mixing container is selectively rotatable upon the base,
the base comprises at least two spaced apart box tubes,
the box tubes adapted to receive tines of a fork lift machine,
the mixing container having a generally cylindrical sidewall and closed ends,
the screw conveyor comprises a discharge duct communicative therewith,
a control pendant is coupled to the first motor and to the second motor,
an internal combustion engine is supported on the mixing container,
a hydraulic pumping system operatively coupled to the internal combustion engine,
each of the first motor and the second motor is a hydraulic motor coupled to the hydraulic pumping system,
the screw conveyor comprises a first segment disposed below the mixing container and a second segment disposed exterior of the mixing container,
the screw conveyor comprises a discharge duct communicative therewith,
a closure element is selectively operable to prevent passage of mortar through the discharge duct,
the bottom opening of the mixing container extends substantially the length of the mixing container.

9. Mortar mixing apparatus comprising
a base on which a mixing container is supported,
a screw conveyor disposed below the mixing container,
the mixing container having a bottom opening communicative with the screw conveyor,
a first motor operatively coupled to the screw conveyor,
the screw conveyor selectively operable by the first motor in a clockwise rotation or in a counterclockwise rotation,
the mixing container further comprising an agitator assembly centrally located therein,
the agitator assembly coupled to a second motor,
the second motor selectively operable independently of the first motor,
the agitator assembly selectively operable to intermix mortar ingredients located in the mixing container while the screw conveyor is operated to force mortar ingredients in the screw conveyor into the mixing container,
the screw conveyor comprises a first segment disposed below the mixing container and a second segment disposed exterior of the mixing container,
the first segment of the screw conveyor including an elongate opening in an enclosing housing thereof at an upper area thereof,
the elongate opening of the screw conveyor housing coincident with the bottom opening of the mixing container,
the elongate opening narrower than a diameter of the enclosing housing.

10. Mixing and transport apparatus for mortar comprising
a mixing container having an agitator rotatable therein,
means to selectively rotate the agitator,
an elongate opening at a bottom of the mixing container,
a screw conveyor disposed below the mixing container,
the screw conveyor communicative with the elongate opening of the mixing container,
the screw conveyor comprising a cylindrical housing and a powered screw disposed in the housing,
the housing of the screw conveyor having a slot at a top thereof,
the slot aligned with the elongate opening of the mixing container,
means to selectively rotate the screw in either a clockwise or a counterclockwise direction,
the screw rotated in a direction urging material in the screw conveyor housing into the mixing container when the agitator is rotated,
an upper cylindrical portion of the cylindrical housing of the screw conveyor is touchingly engaged with lower ends of sidewalls of the mixing container,
the lower ends of the sidewalls defining the slot at the top of the cylindrical housing of the crew conveyor,
the slot narrower than a diameter of the cylindrical housing.

11. The mixing and transport apparatus of claim 10 wherein
fork receiving tubes are mounted on the mixing container.

12. The mixing and transport apparatus of claim 10 wherein
the screw conveyor extends from below the mixing container.

13. The mixing and transport apparatus of claim 10 wherein
the screw conveyor extends from below the mixing container,
the screw conveyor extends the length of the mixing container.

14. Mixing and transport apparatus for mortar comprising
a mixing container having an agitator rotatable therein,
means to selectively rotate the agitator,
an elongate opening at a bottom of the mixing container,
a screw conveyor disposed below the mixing container,
the screw conveyor communicative with the elongate opening of the mixing container,
the screw conveyor comprising a cylindrical housing and a powered screw disposed in the housing,
the housing of the screw conveyor having a slot at a top thereof,
the slot aligned with the elongate opening of the mixing container,
means to selectively rotate the screw in either a clockwise or a counterclockwise direction,
the screw rotated in a direction urging material in the screw conveyor housing into the mixing container when the agitator is rotated,
an outer periphery of the agitator passes through the slot at the top of the housing of the screw conveyor when the agitator is rotated.

15. Mixing and transport apparatus for fluent masonry material comprising
a cylindrical mixing compartment into which components of the fluent masonry material may be placed to be intermixed,
a screw conveyor disposed below the cylindrical mixing compartment
the screw conveyor comprising a screw and a tubular housing,
the tubular housing having an interior in which the screw is rotatable, an agitator centrally disposed in the mixing compartment to intermix the components of the fluent masonry material, the agitator selectively operable independently of the screw, the mixing compartment communicative with a length of the interior of the housing of the screw conveyor, the screw of the screw conveyor selectively operable in a forward direction or in a reverse direction, the screw urging material into the mixing compartment from the tubular housing when operated in the reverse direction, the screw conveyor selectively operable in the reverse direction when the agitator is operated, the mixing compartment comprises opposing semi-cylindrical sidewalls and opposing end walls, the end walls disposed substantially vertically, lower ends of the semi-cylindrical sidewalls defining an elongate slot therebetween, the elongate slot disposed at a generally lowermost region of the mixing compartment, the tubular housing of the screw conveyor including an elongate opening in alignment with the elongate slot of the mixing compartment, the screw disposed exterior of the mixing compartment, the elongate slot substantially narrower than a diameter of the tubular housing, distal elements of the agitator pass through the elongate opening of the tubular housing of the screw conveyor when the agitator is rotated.

16. The mixing and transport apparatus for fluent masonry material of claim 15 wherein the agitator is selectively driven by a first hydraulic motor, the screw of the screw conveyor is selectively driven by a second hydraulic motor, each of the first hydraulic motor and the second hydraulic motor being independently operable.

17. The mixing and transport apparatus for fluent masonry material of claim 16 wherein a controller is coupled to each of the first hydraulic motor and the second hydraulic motor, the controller selectively operable to cause operation of the first hydraulic motor, the controller selectively operable to cause the second hydraulic motor to operate in a forward direction, the controller selectively operable to cause the second hydraulic motor to operate in a reverse direction.

18. The mixing and transport apparatus for fluent masonry material of claim 15 wherein the mixing compartment comprises opposing semi-cylindrical sidewalls and opposing end walls, the end walls disposed substantially vertically, lower ends of the semi-cylindrical sidewalls defining an elongate slot therebetween, the elongate slot disposed at a generally lowermost region of the mixing compartment, the tubular housing of the screw conveyor including an elongate opening in alignment with the elongate slot of the mixing compartment, the screw disposed exterior of the mixing compartment.

* * * * *